US005442982A

United States Patent [19]

Bell

[11] Patent Number: 5,442,982

[45] Date of Patent: Aug. 22, 1995

[54] NESTING POCKET SCREWDRIVERS

[76] Inventor: Dennis J. Bell, 21825 Eaton Pl., Cupertino, Calif. 95014

[21] Appl. No.: 157,818

[22] Filed: Nov. 26, 1993

[51] Int. Cl.[6] ..... B25B 23/00

[52] U.S. Cl. ..... 81/439; 81/124.4; 81/490; 7/165

[58] Field of Search ..... 81/124.4, 177.4, 439, 81/490; 7/165

[56] References Cited

U.S. PATENT DOCUMENTS

| | | | |
|---|---|---|---|
| 662,748 | 11/1900 | Wood . | |
| 1,250,328 | 12/1917 | Langford | 81/439 X |
| 2,196,849 | 4/1940 | Beeg | 81/439 |
| 4,096,896 | 6/1978 | Engel . | |
| 4,273,173 | 6/1981 | Smith et al. . | |
| 4,300,607 | 11/1981 | Mellinger | 81/490 |
| 4,327,790 | 5/1982 | Stevens et al. . | |
| 4,372,361 | 2/1983 | Whiteford . | |
| 4,372,362 | 2/1983 | Ahn . | |
| 4,434,828 | 3/1984 | Trincia . | |
| 4,463,788 | 8/1984 | Corona et al. . | |
| 4,515,046 | 5/1985 | Johnson . | |
| 4,552,044 | 11/1985 | Corona et al. . | |
| 4,827,812 | 5/1989 | Markovetz . | |
| 4,924,733 | 5/1990 | McKenzie . | |

FOREIGN PATENT DOCUMENTS

| | | |
|---|---|---|
| 403769 | 1/1934 | United Kingdom . |

*Primary Examiner*—James G. Smith

[57] ABSTRACT

Handtools, typically two screwdrivers with a slotted tip (14) and a crossheaded (Phillips) tip (24), respectively nest together for pocket storage in one compact package without any protruding points or tips. Tip (14) is attached to blade (or shaft) (12) that mounts on handle (or body) (10). Tip (or bit or head) (24) is attached to blade (22) that mounts on handle (20). For storage, the two handtools are placed in opposition and brought together to mate hermaphroditically, with blade (12) entering bore (or hole) (16) in handle (20) and blade (22) entering bore (16) in handle (10). When so nested, both blades and tips are completely covered to protect the user's clothing when stored in a pocket. The resulting package is approximately the same length as a single tool and has the same diameter, yet is easily pulled apart so that both tools become fully usable separately.

16 Claims, 3 Drawing Sheets

NESTING POCKET SCREWDRIVERS

BACKGROUND—FIELD OF INVENTION

This invention relates to handtools, such as screwdrivers, especially to those that are compact enough to be carried in a pocket.

BACKGROUND—DESCRIPTION OF PRIOR ART

Electronic technicians, mechanics, and hobbyists have a need for small tools that are easily accessed, often by being clipped to a pocket. One class of such handtools is characterized by having a handle to which is fixed a blade, which blade can have a tip of several types. Screwdrivers are one such tool in this class; the two most common screwdriver tip types are slotted (flat-headed) and Phillips (cross-headed), although many other types are used.

A useful pocket screwdriver of this type meets three criteria. First, it has at least two blades or tips, e.g., a slotted tip and a cross-headed tip, so that a single tool can have multiple uses. Second, it can be stored compactly, for ease of carrying in a pocket, with the blades and tips shielded to protect the user and their clothing. Third, it can be converted easily from its storage position to its useful position, so that the user can quickly access the needed tool.

Wood, in U.S. Pat. No. 662,748 (1900), shows a handle with a tool which can be retracted into the handle for storage or moved out into a working position and locked therein. However, Wood only shows a single tool having a single tip, precluding multiple uses. While it is conceivable that multiple interchangeable tools could be used in the invention of Wood, Wood makes no provision for the storage of more than one tool.

Langford, in U.S. Pat. No. 1,250,328 (1917), describes a combination tool with three nested members, each having a handle and a blade. The smallest member fits inside the next largest member, the two of which then fit inside the largest member, with attachment of the members by threaded portions between each member. While this allows multiple tool types, each with its own handle, it is time consuming to use the inside tools due to the need to unscrew each tool from the other. Also, Langford's tool is not useful for pocket storage, since the outside tool has a large diameter handle that is not compact enough to fit in a pocket and an exposed tip that may damage the user's clothing.

Mellinger, in U.S. Pat. No. 4,300,607 (1981), shows a two-part handle holding two double-ended bits, with one double-ended bit stored inside the handle and one bit stored in its working position. When the two-part handle is separated by pulling it apart, each part becomes a gripping member that can hold a different bit and can be used as a separate tool. However, Mellinger's tool is not useful for pocket storage, because it has an excessive overall length defined by the length of the upper gripping member adding to the length of the lower gripping member and shaft. Also, as with Langford's tool, Mellinger's tool does not protect the user when stored in a pocket, since the tool has an exposed shaft and tip.

Beeg, in U.S. Pat. No. 2,196,849 (1940), shows a single handle with two fixed screwdriver blades, one at each end, each blade being covered by a removable cap. To convert Beeg's pocket screwdriver from the storage position to the operating position a cap must be removed to expose a screwdriver blade. It is awkward to switch Beeg's tool from operation with one blade to the other, since the first cap must be found and replaced and then the other cap removed. In operation the screwdriver tool facing the user's hand is covered by a cap. Since the cap can easily swivel with respect to the exposed screwdriver blade, Beeg's tool is not able to exert a useful turning force.

Stevens et al., in U.S. Pat. No. 4,327,790 (1982), show a screwdriver having a handle with blades which pivot out and lock into position, and can be folded flush for storage. This arrangement has multiple blades that are protected in the storage position. The blades are attached to the handle so that they cannot be lost. However, the blade pivot and locking mechanism requires a relatively awkward operation to move a blade from its storage to its operating position. The user must repeat this manipulation to switch to an alternate tool. Further, Stevens' pivot mechanism and bent blades require a thick handle that would be unsuitable for carrying in a pocket.

Johnson, in U.S. Pat. No. 4,515,046 (1985), describes a retractable torque applying tool that has a push button retracting mechanism in a pen-like arrangement. This mechanism allows quick operation to extend the tool for use and back again for protected storage. However, Johnson's tool is limited to a single tip or blade. This greatly limits the utility of the tool, essentially requiring the user to carry two or more separate tools. Further, the retracting mechanism limits the useful length of the tool shank, so the relatively thick handle can limit access to the work area.

Hibbard, in British patent 403,769 (1934), describes a combination tool with a metal tubular body, or handle, having hexagonal openings at both ends that hold interchangeable bits with a hexagonal shaft. The bits may be reversed so that the tool tips are enclosed in the tubular body for storage. Markovetz, in U.S. Pat. No. 4,827,812 (1989), describes a similar pocket screwdriver tool, having a handle with a single hexagonal end opening. The bits are stored inside the hollow handle. The tools described by Hibbard and Markovetz both have several small bits that are easily misplaced. These tools require several actions or manipulations to place the bit into position for use, and several more manipulations to return the tool to its storage configuration. These tools are also limited to a single handle, so that a user must switch bits to use an alternative tool. Lastly, these tools are not useful when the tool blade diameter must be small to gain access to the work area-the bit holding mechanism of both the tool of Hibbard and that of Markovetz is bulky and of large diameter.

There are many tools described in the prior art having interchangeable blades or tips that engage a blade holder in the handle, which blades or tips may be stored inside the handles. Engel, in U.S. Pat. No. 4,096,896 (1978), shows a handle with insertable tools. Smith et al., in U.S. Pat. No. 4,273,173 (1982), shows a handle with double-bitted insertable tips. Whiteford, in U.S. Pat. No. 4,372,361 (1983), shows a screwdriver with pockets in the handle for various bits. Ahn, in U.S. Pat. No. 4,372,362 (1983), shows a housing with a plurality of extendable bits. Trincia (1984) shows a screwdriver with a handle containing various bits which can be inserted into the open end of the handle. Corona et al., in U.S. Pat. Nos. 4,463,788 (1984) and 4,552,044 (1985), show a screwdriver with a handle and a plurality of bits which can be positioned individually into working positions through the use of a rotary mechanism. McKenzie, in U.S. Pat. No. 4,924,733 (1990), shows a multi-bit screwdriver with the bits housed in pockets in the handle. These tools all have the same problems as described for those of Hibbard and Markovetz. In addition, many of these tools have bulky mechanisms for storing and selecting tool bits, so that the tool would be unsuitable for carrying in a pocket. These complicated mechanisms are also difficult and expensive to make.

In summary, prior-art pocket tools have the following disadvantages:

(a) Tools having more than one tip, and provision for protecting the user from the tips when the tips are stored, require several time-consuming manipulations to place the tips into operating position, to exchange the tips for differing operations, and to place the tips back into storage position.

(b) Tools having more than one tip also require a bulky, and expensive, tip-holding mechanism that can interfere with use of the tool when the access space is restricted or make the tool unsuitable for carrying in a pocket.

(c) Tools that do not have bulky and expensive tip holding mechanisms, and that do not require time-consuming operations to place the tips into operating position, are limited to a single tip, are not compact enough for pocket storage, or have at least one unprotected tip.

In summary, prior-art pocket handtools have not been useful because they did not simultaneously meet the three criteria of having multiple blades or tips, compact and protected storage, and ease of operation.

OBJECTS AND ADVANTAGES

Accordingly, several objects and advantages of the present invention are:

(a) To provide handtools having at least two blades that nest into a single unit for convenient pocket storage, easily converting from storage position to operating position.

(b) To provide pocket handtools each having a handle and a blade that nest compactly together for storage, eliminating bulky and expensive tip-holding and changing mechanisms that can interfere with use of tools when the work access space is restricted.

(c) To provide pocket handtools that cover the blades, or tips, when nested to protect the user and their clothing so that the tools may be carried safely in a pocket.

The above and still further objects and advantages will become apparent from a consideration of the ensuing description and drawings.

DRAWING FIGURES

REFERENCE NUMERALS IN DRAWINGS

Figure 1A:
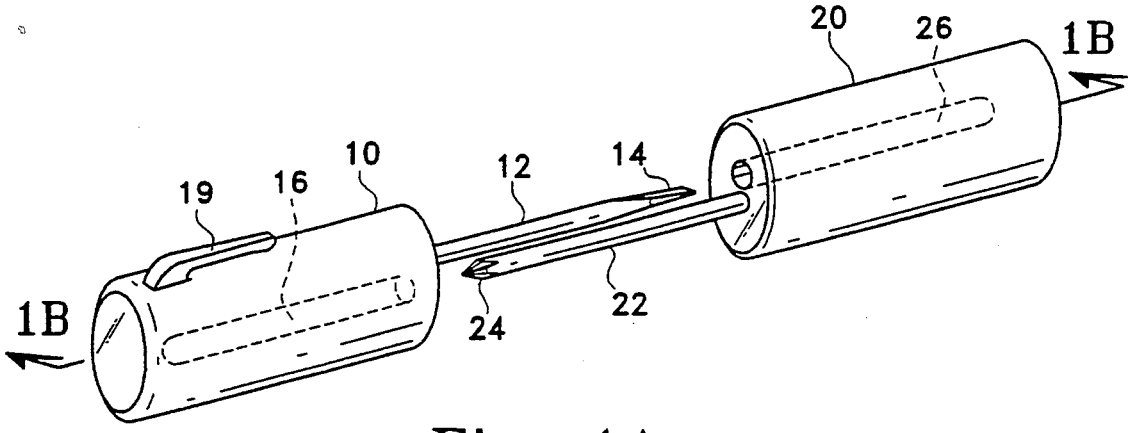
FIG. 1A shows a perspective view of a pair of nesting screwdrivers in accordance with a first embodiment of my invention where the blades are completely covered during storage; the screwdrivers are illustrated in their separated position.

10 first tool handle
12 first tool blade
14 first tool tip
16 bore in first tool that accepts second tool blade
18 first tool blade securing tabs
19 pocket clip
20 second tool handle
22 second tool blade
24 second tool tip
26 bore in second tool that accepts first tool blade
28 second tool blade securing tabs
30 first tool handle
32 first tool blade
34 first tool tip
36 slot in first tool that accepts second tool blade
38 magnet in first tool handle
40 second tool handle
42 second tool blade
44 second tool tip
46 slot in second tool that accepts first second tool blade
48 magnet in second tool handle
50 first tool handle
52 first tool blade
54 first tool tip
56 oval bore in first tool that accepts second tool blade
58 bend in first tool blade
59 pocket clip
60 second tool handle
62 second tool blade
64 second tool tip
66 oval bore in second tool that accepts first tool blade
68 bend in second tool blade

DESCRIPTION—FIGS. 1A, 1B, AND 1C—BORES AND STRAIGHT BLADES

Figure 1B:
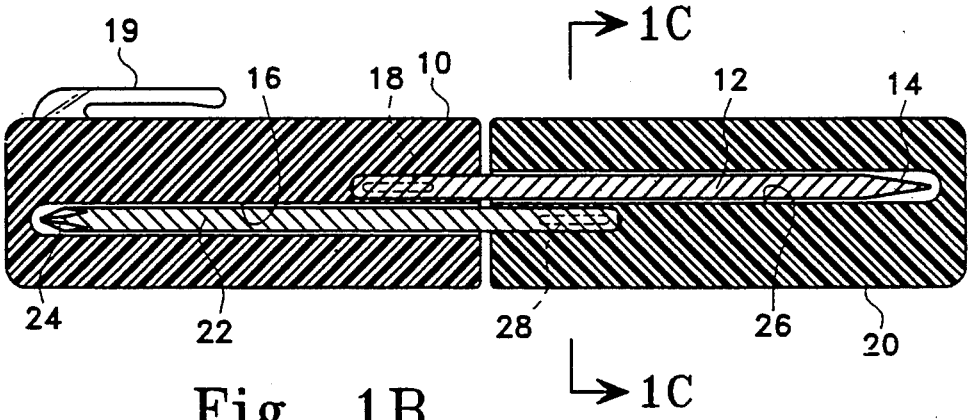
FIG. 1B shows a cross-sectional side view of the screwdrivers of FIG. 1A in their nested, storage position.
Figure 1C:
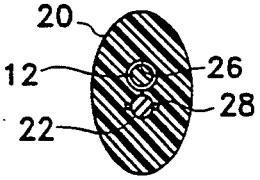
FIG. 1C shows a cross-sectional view, normal to their center line, of the screwdrivers of FIG. 1A in their nested, storage position.

A first embodiment of a pair of nesting pocket screwdrivers using bores to engage straight blades is illustrated in FIG. 1A—a perspective view, in FIG. 1B—a cross-sectional side view of FIG. 1A as taken along line 1B—1B, and in FIG. 1C—a cross-sectional end view of FIG. 1A as taken along line 1C—1C. The screwdrivers as shown in FIG. 1A comprise first and second screwdrivers. The first screwdriver comprises a first tool handle (or body) 10, to which is secured a first tool blade (or shank or shaft) 12. A first tool tip (or bit or head) 14, shown as a slotted tip, is formed into the distal end of blade 12. A bore (or hole or cavity) 16 is provided in handle 10. Two tool blade tabs 18, as shown in FIG. 1B, are formed onto opposite sides of blade 12 inside handle 10 to assist in securing blade 12 against torquing forces. A pocket clip 19 attaches to handle 10.

The second screwdriver comprises a second tool handle 20, to which is secured a second tool blade 22. A second tool tip 24, shown as a cross-headed (Phillips) tip, is formed into the distal end of blade 22. A bore 26 is provided in handle 20. Two tool blade tabs 28 as shown in FIGS. 1B and 1C, are formed onto opposite sides of blade 22 inside handle 20 to assist in securing blade 22 against torquing forces. A pocket clip (not shown) can be attached to handle 20.

As shown in FIG. 1C handles 10 and 20 are similarly sized with generally uniform, elliptical cross sections. Handles 10 and 20 can also have any other desired outside shape, including oval, cylindrical, or polygonal. Flutes or knurls can also be arranged on the surfaces of handles 10 or 20. Separate resilient gripping material can also be attached to the outside of handles 10 or 20. Any of these described shapes, surfaces, and materials can be differentially used for handles 10 and 20, so as to assist in distinguishing the tools from each other.

As shown in FIG. 1A, blades 12 and 22 extend out from and parallel to the longitudinal axes of handles 10 and 20 respectively. As shown in the handle cross section of FIG. 1B, blade 22 is typically mounted offset from the cross sectional center axis of handle 20. As shown in the handle cross section of FIG. 1C, blade 22 is also typically mounted on the cross sectional major axis of the elliptical cross section of handle 20. Bore 26 is also typically parallel to the longitudinal axis and typically offset from the cross sectional center axis and on the cross sectional major axis of handle 20. Blade 12 is typically mounted offset from the cross sectional center axis and on the cross sectional major axis of handle 10 by the same distance and in the same direction as bore 26 is offset from the center axis of handle 20. Bore 16 is also typically parallel to the longitudinal axis and typically offset from the cross sectional center axis and on the cross sectional major axis of handle 10 by the same distance and in the same direction as blade 22 is offset from the center axis of handle 20. As a result of the typical mounting offsets of blades 12 and 22 to the axes of handles 10 and 20 respectively, and of the offsets of bores 26 and 16 to the axes of handles 20 and 10 respectively, handles 10 and 20 will form a single continuous outside form when the screwdrivers are in the nested position, as shown in side cross section in FIG. 1B and as described infra under "Operation." Bore 16 can optionally be provided in the center axis of handle 10 and blade 22 can optionally be mounted on the center axis of handle 20 respectively, as a design choice to provide the second screwdriver with a shank that is coaxial with its handle. With this option, the offset of blade 12 from handle 10 would be made somewhat larger, to allow a single continuous outside form in nested position. Alternately, both blades 12 and 22 can be mounted on the center longitudinal axes of handles 10 and 20 respectively, but in that case the nested tools will not have a single continuous outside form.

As shown in FIGS. 1A, 1B, and 1C, bores 26 and 16 have cylindrical cross sections. Bore 26 has a sufficient opening and inside diameter to accept blade 12, and can have a greater diameter at its opening to easily accept blade 12 and a narrowed diameter at the bottom of bore 26 to engage and hold blade 12 for storage. Bore 16 has a sufficient opening and inside diameter to accept blade 22, and can have a greater diameter at its opening to easily accept blade 22 and can have a narrowed diameter at the bottom of bore 16 to engage and hold blade 22 for storage.

In this embodiment, the cross sections of blades 12 and 22 are shown as cylinders. Optionally, any of the blade cross sections described in the prior art, including polygonal or flattened, can be used. Blades 12 and 22 can have tool surfaces along their extending length, including serrations for filing or sharpened edges for cutting. Blades 12 and 22 can also have varying dimensions through their length. Blades 12 and 22 can also have different blade cross sections than each other. Correspondingly, bores 26 and 16 can have any other cross section, including varying dimensions through their extending length, as long as bores 26 and 16 are sized to accept the maximum cross section of inserted blades 12 and 22 respectively.

In this embodiment, bores 16 and 26 engage blades 22 and 12 respectively for storage in at least one location along their extended length to hold the screwdrivers together in their nested storage position by means of resiliency in the material of handles 10 and 20, as described under "Operation." Any of the methods described in the prior art for securing blades 22 and 12 into handles 10 and 20 for storage can be applied instead, such as clips, C-rings, springs, spring and ball engaging detents, resilient 0-tings, and magnets. As an alternative to blade-to-handle securing methods, the first and second screwdrivers can be held together during storage by securing handle 10 to handle 20. Any known releasible securing technique, including an engaging resilient pawl and slot, an engaging resilient ball and socket, or magnets, may be provided on handles 10 and 20 to secure these handles together.

As shown in FIGS. 1B and 1C, tabs 18 and 28 are formed into pairs on blades 12 and 22 respectively, to secure the blades against turning in their mount in handles 10 and 20. Alternately, any other known permanent securing method can be employed, including: forced fit, single or multiple tabs, knurled sections on the blades, bent blades inside the handles, adhesive or other bonding that does not require tabs, or any combination of these methods.

In this embodiment, tips 14 and 24 are shown as a slotted (flat head) and a cross-head (Phillips) screwdriver respectively. Alternately, tips 14 and 24 can be any desired tool head, including hex, internal line head, external line head, spline, awl, chisel, or flat point.

Dimensions

In this embodiment the screwdrivers are sized for convenient manipulation by hand operations and for storage within a shirt pocket. Handles 10 and 20 typically have an elliptical cross section with a 0.5 cm to 1.5 cm minor axis and a 0.5 cm to 2.5 cm major axis, and a length of 2 cm to 8 cm. Handles 10 and 20 are typically identical in outside shape and size, but can be made with different diameters and lengths if desired. Blades 12 and 22 have a smaller maximum cross section dimension and extending length than handles 10 and 20 respectively. In this embodiment, blades 12 and 22 are typically 0.1 cm to 0.5 cm in diameter and 1.9 cm to 7.9 cm long, including tips 14 and 24. Bores 16 and 26 are slightly larger than the maximum cross section of blades 22 and 12 respectively, typically by 0.01 cm to 0.1 cm. The distance between blade 12 and bore 16 and between blade 22 and bore 26 is made small consistent with providing adequate securing material in handles 10 and 20, typically 0 cm to 0.2 cm. Tabs 18 and 28 project small distance from blades 12 and 22, typically five to fifty percent of the respective blade diameters.

Tips 14 and 24 can be made in any desired size, consistent with fitting into bores 26 and 16 respectively. Preferably tips 14 and 24 are selected as standard sizes, typically 3/32" (0.238 cm), ⅛" (0.317 cm), 3/16" (0.476 cm), 7/32" (0.556 cm), ¼" (0.635 cm) or #0, #1, #2, #3, #4, #5 for slotted heads and typically #0, #1, #2, and #3 for cross-headed (Phillips) heads. When other tool tips are selected, standard sizes can be specified as well.

Materials

Many materials are suitable for handles 10 and 20. This material will preferably have a high resistance to failure by impact and will preferably have sufficient strength to hold blades 12 and 22 in place against forces that can be applied by hand. Such materials include polymers, metals, or wood. The material can be colored, or coated with a color layer, differently for handles 10 and 20 to assist in identifying the different tool tips.

Typically, blades 12 and 22 and tips 14 and 24 will be metal. Metals can withstand the high forces generated in most tool operations. Polymers may be used for blades and tips in applications where non-conductivity is required in combination with small forces on the tool. Typical metals for blades 12 and 22 and tips 14 and 24 are alloy steels, which can be machined, tempered, mechanically surface treated, plated with other metals, or provided with oxide coatings if desired.

Construction

The screwdrivers can be constructed by any known method. The novel arrangement of an offset axis mount for blades 12 and 22 do not require any significant modification to the present methods of construction. The novel arrangement of bores 16 and 26 can be constructed by several methods. One method is to cast bores 16 and 26 in place during an injection or poured molding operation of handles 10 and 20, using a bore-shaped mandril that is removed once the handle material has set. Another method is to cast one-half of each handle 10 and 20, where the halves are defined by a cutting plane joining the center of bores 16 and 26 with blades 12 and 22 respectively. Once each half has set, it is removed from the mold and joined by adhesives or other method to the other half to form a complete handle. Another method is to drill bores 16 and 26 in handles 10 and 20 respectively from the blade-mounting end Of each handle before blades 12 and 22 are mounted. Yet another method is to drill bores 16 and 26 in handles 10 and 20 respectively from the end of each handle opposite from blades 12 and 22 after blade mounting. Once drilled, a plug of material can be inserted to close the distal end of each bore.

OPERATION—FIGS. 1A, 1B, AND 1C—BORES AND STRAIGHT BLADES

In operation, the first and second screwdrivers are used normally for the most part, except that in this typical embodiment blades 12 and 22 are mounted at an offset from the center axes of elliptical handles 10 and 20, so that in turning operation handles 10 and 20 will wobble in the hand. Such a wobble will interfere with spinning of the screwdriver handles 10 and 20 with an action of the thumb and forefinger. However, that offset can give more leverage to screwdriver operation when quick spinning is not required. Such a novel screwdriver operation may not be desired for both first and second screwdrivers, and as noted supra under "Description" the second screwdriver can have blade 22 mounted on the center axis of handle 20 if desired, so that one of the screwdrivers may be used more conventionally. With elliptical cross sections in handles 10 and 20, quick spinning of the tool may be constrained. However, such non-symmetric handles can assist the user in identifying the orientation of blades and tips in operation with the work.

In this embodiment, bores 16 and 26 are nearly completely covered by handles 10 and 20. The only opening of bores 16 and 26 is provided in the handle ends that mount blades 12 and 22, and would not normally interfere with either gripping or tool operation.

In operation to place the first and second screwdrivers into storage position, handles 10 and 20 are placed in opposition as illustrated in FIG. 1A with blades 12 and 22 pointing towards each other and lining up with bores 26 and 16 respectively. Handles 10 and 20 are brought towards each other until they touch together, so that, in a hermaphroditic manner, blade 12 enters bore 26 and blade 22 enters bore 16. In that position blades 12 and 22, and tips 14 and 24, are completely covered by handles 20 and 22 respectively. A slight narrowing of bores 16 and 26 at their distal ends engages tips 24 and 14 respectively, using some resilience in the material of handles 10 and 20, to keep the screwdrivers in their nested position. Once in storage position, the nested screwdrivers may be secured to a pocket using pocket clip 19.

In operation to use the first or second screwdrivers, the nested screwdrivers are first unclipped from the pocket. To disengage the screwdrivers, handles 10 and 20 are merely pulled apart, so that both screwdrivers become fully usable. Optionally, both screwdrivers can be provided with pocket clips so that one of the screwdrivers can be clipped back into the pocket while the other is in use.

DESCRIPTION—FIGS. 2A, 2B, AND 2C—OPEN SLOT AND STRAIGHT BLADES

Figure 2A:
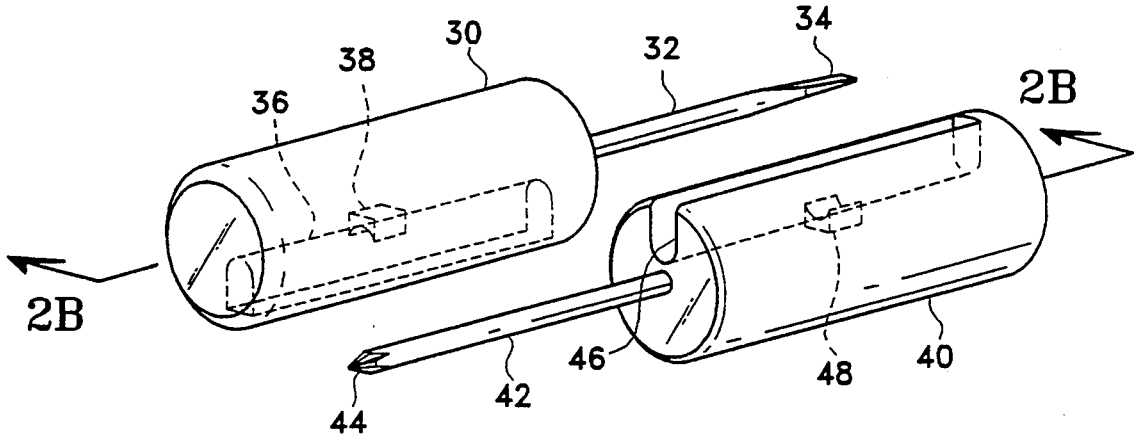
FIG. 2A shows a perspective view of nesting screwdrivers in accordance with a second embodiment of my invention where one side of each blade is exposed during storage; the screwdrivers are illustrated in their separated position.
Figure 2B:
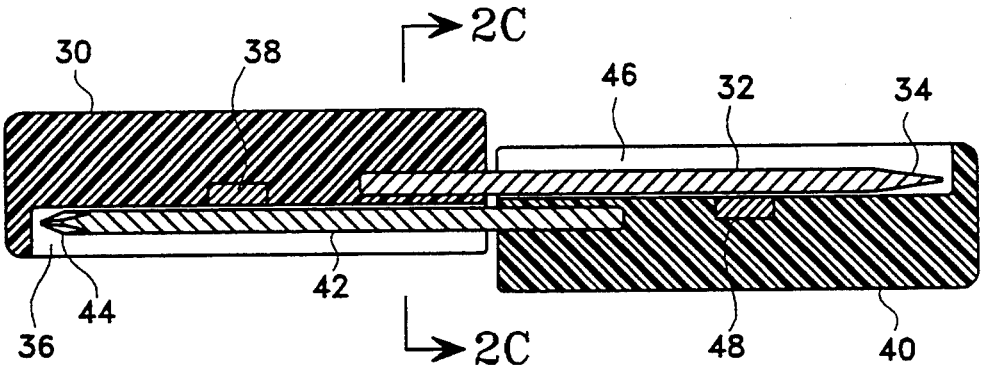
FIG. 2B shows a cross-sectional side view of the screwdrivers of FIG. 2A in their nested, storage position.
Figure 2C:
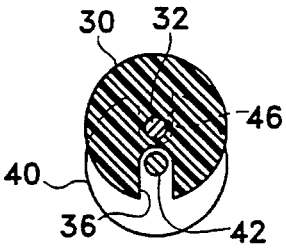
FIG. 2C shows a cross-sectional view, normal to their center line, of the screwdrivers of FIG. 2A in their nested, storage position.

A second embodiment of a pair of nesting pocket screwdrivers, this time using open slots to engage straight blades, is illustrated in FIG. 2A—a perspective view, in FIG. 2B—a cross-sectional side view of FIG. 2A as taken along line 2B—2B, and in FIG. 2C—a cross-sectional end view of FIG. 2A as taken along line 2C—2C. The first screwdriver comprises a first tool handle (or body) 30, to which is secured a first tool blade (or shank) 32. A first tool tip (or head) 34, shown as a slotted tip, is formed into the distal end of blade 32. A slot (or channel or groove or cavity) 36 is provided in handle 30.

The second screwdriver comprises a second tool handle 40, to which is secured a second tool blade 42. A second tool tip 44, shown as a Phillips tip, is formed into the distal end of blade 42. A slot 46 is provided in handle 40.

As shown in FIG. 2C in this embodiment handles 30 and 40 are similarly sized with generally uniform, cylindrical cross sections. Handles 30 and 40 can also have any other desired outside shape, including elliptical, oval, or polygonal, and may have flutes, knurls, or a separate resilient gripping material covering. Clips (not shown) can be mounted on one or both of handles 30 and 40 for securing to a pocket.

As shown in FIG. 2A, blades 32 and 42 typically extend out from the center longitudinal axes of handles 30 and 40 respectively. Slots 36 and 46 are provided in handles 30 and 40 respectively having an opening large enough to accept blades 42 and 32. Slots 36 and 46 extend in length, width, and depth typically slightly greater than the length, width, and depth of blades 42 and 32 respectively.

As shown in FIG. 2B, with the described typical mounting of blades 32 and 42 on the center axes of handles 30 and 40, slots 36 and 46 cannot extend to the center axes, and in the nested position the screwdrivers will not form a single continuous outside form. Alternately, as in the first embodiment described in FIGS. 1A, 1B, and 1C, one or both of blades 32 and 42 can be mounted offset from the center axes of handles 30 and 40 so that one or both of slots 36 and 46 can extend to the center axes, and in the nested position the screwdrivers will form a single continuous outside form.

While the cross sections of blades 32 and 42 are shown as cylinders, alternatively different blade cross sections and tool surfaces can be used, which sections and surfaces can differ on each blade 32 and 42. Any of the methods described previously or in the prior art can be employed for securing blades 32 and 42 to handles 30 and 40.

Blades 32 and 42 are secured in storage position in handles 40 and 30 respectively by magnets 48 and 38. Permanent magnets 48 and 38 are placed inside handles 40 and 30 at the bottom of slots 46 and 36. Typically, the magnetic poles of 48 and 38 are oriented so that one pole faces into slots 46 and 36. Other methods for securing blades to handles, or handles to handles, that have been described previously can also be used.

Tips 34 and 44 are shown as a slotted head and a Phillips head screwdriver respectively. As described previously, other tip types can be used.

Dimensions

Typical dimensions follow those previously described for the first embodiment of bores and straight blades. Slots 36 and 46 are typically just larger in width than the maximum cross section of blades 42 and 32 respectively, typically by 0.01 cm to 0.1 cm. The distance between blade 32 and the bottom of slot 36 and between blade 42 and bottom of slot 46 is typically made small consistent with providing adequate securing material in handles 30 and 40, typically 0 cm to 0.2 cm. Magnets 38 and 48 are typically small, 0.2 to 0.5 cm in length, width, and depth.

Materials

Typical materials follow those previously described for the first embodiment of bores and straight blades. Permanent magnets 38 and 48 can be selected from any of the commercially-available ferromagnetic materials. Blades 32 and 42 are selected from steels that are attracted by the magnet materials selected for magnets 48 and 38 respectively.

Construction

The screwdrivers can be constructed by any of the methods described in the prior art. The novel slots 36 and 46 can be constructed by several methods. One method is to cast slots 36 and 46 in place during an injection or poured molding operation of handles 30 and 40. Another method is to machine slots 36 and 46 in handles 30 and 40.

OPERATION—FIGS. 2A, 2B, AND 2C—SLOTS AND STRAIGHT BLADES

The first and second screwdrivers are used normally. Blades 32 and 42 are mounted on the center axes of handles 30 and 40, so that in turning operation handles 30 and 40 will spin without a wobble. Alternatively, such a conventional screwdriver operation may not be needed for both first and second screwdrivers, and as noted in the description supra, one or both of blades 32 and 42 can be mounted offset from the center axes of handles 30 and 40 if desired, so that one or both screwdrivers would have an off-center blade and would wobble when turned.

Slots 36 and 46 are open to the outside of handles 30 and 40. As such, these openings will be felt by the user's hand, but will not interfere with gripping if the slot is relatively small in width compared to the width of the handle. These slots can help provide additional gripping traction and can help the user identify the orientation of blades and tips in operation with the work.

To place the first and second screwdrivers into storage position, handles 30 and 40 are placed as shown in FIG. 2A with blades 32 and 42 opposite slots 46 and 36 respectively. Handles 30 and 40 are moved so that blade 32 enters slot 46 and blade 42 enters slot 36. In that position blades 32 and 42, and tips 34 and 44, are completely covered by handles 40 and 42 respectively. Blades 32 and 42 are attracted to magnets 48 and 38 respectively, to keep the screwdrivers in their nested position. Magnets 48 and 38 are sized and magnetized to provide a sufficient force to keep the two screwdrivers together, but not exceeding the force that can easily be applied by hand operations. To disengage, handles 30 and 40 are merely pulled apart, so that both screwdrivers become fully usable.

DESCRIPTION—FIGS. 3A, 3B, 3C, AND 3D—BENT BLADES

Figure 3A:
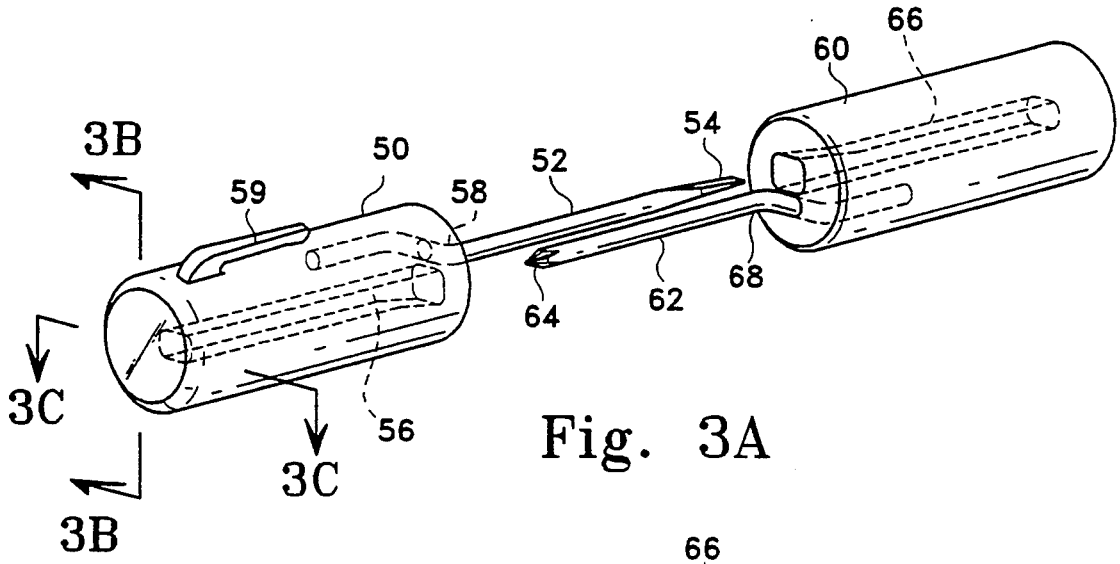
FIG. 3A shows a perspective view of nesting screwdrivers in accordance with a third embodiment of my invention where each blade is bent; the screwdrivers are illustrated in their separated position.
Figure 3D:
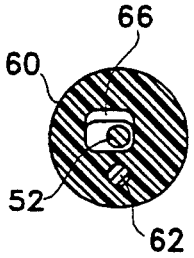
FIG. 3D shows a cross-sectional view, normal to their center line, of the screwdrivers of FIG. 3A in their nested, storage position.
Figure 3B:
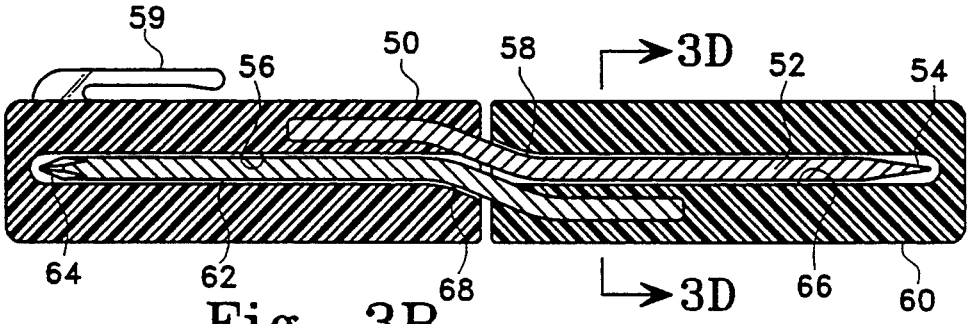
FIG. 3B shows a cross-sectional side view of the screwdrivers of FIG. 3A in their nested, storage position.
Figure 3C:
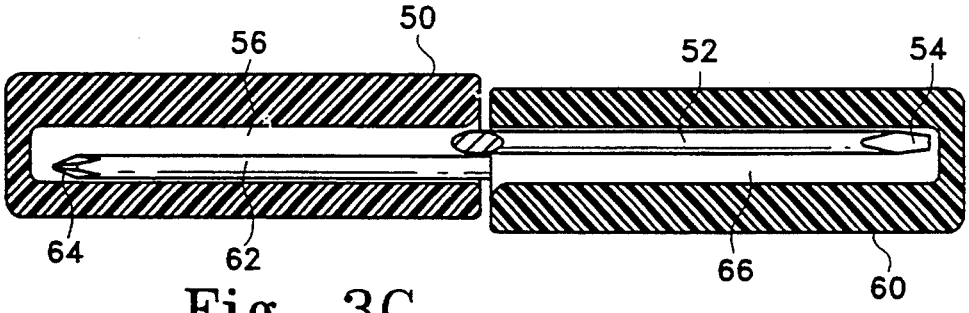
FIG. 3C shows a cross-sectional top view of the screwdrivers of FIG. 3A in their partially nested, storage position.

A third embodiment of a pair of nesting pocket screwdrivers, using oval bores to accommodate bent blades, is illustrated in FIG. 3A—a perspective view, in FIG. 3B—a cross-sectional side view of FIG. 3A as taken along line 3B—3B, in FIG. 3C—a cross-sectional top view of FIG. 3A as taken along line 3C—3C, and in FIG. 3D—a cross-sectional end view of FIG. 3A as taken along line 3D—3D. The first screwdriver comprises a first tool handle (or body) 50, to which is secured a first tool blade (or shank or shaft) 52. A first tool tip (or bit or head) 54, shown as a slotted tip, is formed into the distal end of blade 52. A bore (or hole or cavity) 56 is provided in handle 50. A bend 58 is provided in blade 52. A pocket clip 59 is attached to handle 50.

The second screwdriver comprises a second tool handle 60, to which is secured a second tool blade 62. A second tool tip 64, shown as a Phillips tip, is formed into the distal end of blade 62. A bore 66 is provided in handle 60. A bend 68 is provided in blade 62. A pocket clip (not shown) can be attached to handle 60.

As shown in FIG. 3D handles 50 and 60 are similarly sized with generally uniform, cylindrical cross sections. Handles 50 and 60 can also have any other desired outside shape, including elliptical, oval, or polygonal, and may have flutes, knurls, or a separate resilient gripping material covering.

As shown in FIG. 3A, the tip ends of blades 52 and 62 typically extend out from and parallel to the center longitudinal axes of handles 50 and 60 respectively. Bends 58 and 68 are located in blades 52 and 62 so that the handle ends of blades 52 and 62 enter off of the center axes of handles 50 and 60. Oval bores 56 and 66 are provided in handles 50 and 60 respectively, the oval shape being typically defined as the shape encompassing a circle translated sideways one diameter.

As shown in FIG. 3D, the cross section of oval bores 56 and 66 have one end of the oval centered on the longitudinal axes of handles 50 and 60. Also oval bores 56 and 66 have their major axis extending at right angles to the line connecting handles 50 and 60 center axes to blades 52 and 62 mounting locations within each handle.

As shown in FIGS. 3A, 3B, and 3C oval bores 56 and 66 extend to accommodate the length of blades 62 and 52 respectively. Bores 56 and 66 each have oversized openings in handles 50 and 60 to accommodate bends 68 and 58 respectively when in the nested position as shown in FIG. 3B. It may be appreciated that other shapes other than oval may be provided for bores 56 and 66, as long as the extending length and cross-sectional dimensions of blades 52 and 62 are accommodated in both nested position and nesting operation.

As shown in FIG. 3B, in nested position the screwdrivers will form a single continuous outside form. Blade bends 58 and 68 cause blades 52 and 62 to be co-axial on their portions having tips 54 and 64, but offset on their ends attaching to handles 50 and 60 respectively.

The first and second screwdrivers are secured to each other by the geometry of blades 52 and 62, and blade bends 58 and 68, engaging oval bores 66 and 56 respectively when in nested position. Optionally, one or more groves and ridges can be provided on the facing surfaces of handles 50 and 60 to assist in resisting disengagement of the screwdrivers when in nested position.

Tips 54 and 64 are shown as a slotted head and a Phillips head screwdriver respectively. As described previously, other tip types can be used.

Dimensions and Materials

Typical dimensions and materials follow those previously described for the embodiments using straight blades. Oval bores 56 and 66 are typically just larger in minor axis width than the maximum cross section of blades 62 and 52 respectively, typically by 0.01 cm to 0.1 cm.

Construction

The screwdrivers can be constructed by any of the methods described in the prior art. The novel oval bores 56 and 66 can be constructed by several methods. One method is to cast bores 56 and 66 in place during an injection or poured molding operation of handles 50 and 60, using male mandrils that are removed subsequent to the casting operation. Another method is to cast one-half of each handle 50 and 60, where the halves are defined by the cutting plane of FIG. 3C. Once each half has set, it is removed from the mold and joined by adhesives or other method to the other half to form a complete handle. The novel bends in blades 52 and 62 may be provided by either casting or forging of that shape or by any of the standard metal forming methods.

OPERATION—FIGS. 3A, 3B, 3C, AND 3D—OVAL BORES AND BENT BLADES

Tips 54 and 64, and blades 52 and 62 are mounted on the center axes of handles 50 and 60, so that in turning operation handles 50 and 60 will spin without a wobble. Oval bores 56 and 66 are covered by handles 50 and 60 and will not affect normal operation.

To place the first and second screwdrivers into storage position, handles 50 and 60 are placed as shown in FIG. 3A with blades 52 and 62 opposite bores 66 and 56 respectively and so that blades 52 and 62 are next to each other. Handles 50 and 60 are brought towards each other so that blade 52 enters oval bore 66 and blade 62 enters oval bore 56. When handles 50 and 60 touch at their blade mounting ends, the screwdrivers are in the position shown in the top view of FIG. 3C. Now, handles 50 and 60 are moved slightly sideways, so that blades 52 and 62 lie in the same vertical plane and the screwdrivers will form a single continuous outside form as shown in the side view of FIG. 3B. The nested screwdrivers may be attached to a pocket with clip 59. To disengage, the above operations are reversed, so that both screwdrivers become fully usable.

Summary, Ramifications, and Scope

Accordingly, the reader will see that my nesting pocket tools or screwdrivers have the following advantages over prior pocket handtools:

- They provide tools having more than one tip, for example a slotted head and Phillips head screwdriver, in a compact, easily usable package without any protruding points or tips. To use either driver, the two are simply pulled apart, and both drivers become fully usable as separate tools.
- They eliminate the bulk and expense of tip-holding mechanisms. Without the need for such a mechanism, tool blades or shafts may be thin and can gain access to restricted work areas.

Although the above description contains many specificities, these should not be construed as limiting the scope of the invention, but as merely providing illustrations of some of the presently typical embodiments of this invention. Many other variations are possible. For example, nesting operation into a single unit for storage may be done with more than two tools by providing additional bores or slots, nesting of more than two tools may be effected by having cavities (bores or slots) in some tools and not in others, tools may have more than one blade on each handle, nesting provisions in the handles may combine the described structures of bores and slots and provide different geometries of such structures to accommodate differing blade shapes and nesting operations, nesting operations may combine the described operations of bringing the tools together with substitute or additional operations of translation and rotation, tool handles may be hollow to store additional blades and tips, blades and tips may be interchangeable and removable, etc.

Thus the scope of the invention should be determined by the appended claims and their legal equivalents, rather than by the examples given.

I claim:

1. A pair of screwdrivers which can be stored together in a compact arrangement for pocket carriage, comprising:

a first screwdriver comprising (1) an elongated handle having an axis and pair of opposed ends, and (2) an elongated shaft having an axis and a pair of opposed ends with a screwdriving tip on one of said ends of said shaft, the other end of said shaft extending into one of said ends of said handle so that part of said shaft extends out from said handle, said axis of said shaft being parallel to said axis of said handle, and a second screwdriver comprising (1) an elongated handle having an axis and pair of opposed ends, and (2) an elongated shaft having an axis and a pair of opposed ends with a screwdriving tip on one of said ends of said shaft, the other end of said shaft extending into one of said ends of said handle so that part of said shaft extends out from said handle, said axis of said shaft being parallel to said axis of said handle, each of said handles of each of said screwdrivers having a bore extending into said handle from said one end thereof, said bore being parallel to said axis of said handle and sized to receive said part of said shaft of the other of said screwdrivers which extends out from said handle of said other of said screwdrivers, whereby said pair of screwdrivers can be nested together by inserting said part of said shaft of each of said screwdrivers which extends out from said handle into said bore in said handle of the other of said screwdrivers, so that said screwdrivers can be nested in a compact arrangement and in a manner which covers said tips, yet so that said screwdrivers can be opened from or returned to their nested state easily.

2. The pair of screwdrivers of claim 1, further including means for retaining said pair of screwdrivers together in their nested condition.

3. The pair of screwdrivers of claim 2 wherein said screwdriving tip on said first screwdriver drives slotted-head screws and said screwdriving tip on said second screwdriver drives cross-headed screws.

4. The pair of screwdrivers of claim 3, further including a pocket clip provided on at least one of said handles.

5. An assembly of two handtools which compactly stores in a pocket, comprising:

first and second handtools each comprising (1) an elongated handle, (2) an extending blade, said blade extending generally parallel to the elongated dimension of said handle, (3) means for attaching said blade to said handle, said attaching means being resistant to detachment of said blade from said handle by forces applied to said handtool during use, and (4) a cavity in said handle, said cavity extending generally parallel to the elongated dimension of said handle, said cavity also communicating with the exterior of said handle in an opening, and a tool tip provided on the distal end of at least one of said blades of said handtools, said tool tip being shaped to engage a screw head, said cavities and said communicating openings in each of said handles of said handtools being sized to accept said blades attached to the other of said handtools, said opening in said first handtool being a predetermined lateral distance from said blade in said first handtool, said opening in said second handtool being substantially the same said predetermined lateral distance from said blade in said second handtool, whereby said first and second handtools can be assembled for storage by the operation of positioning said opening in said first handtool opposite said blade in said second handtool while simultaneously positioning said opening in said second handtool opposite said blade in said first handtool, followed by the operation of translating said handtools towards each other to engage each said blade into said cavity of opposite said handle to provide one compact package for storage without protruding blades or tool tips.

6. An assembly of two handtools as in claim 5 wherein said cavities are bores, said bores having said openings at the same end of said handle as the end from which said blade extends, said blades being generally narrow in cross-sectional dimension as compared to the extending length of said blades, said bores each having a depth greater than said extending length of said blade attached to the other said handtool, the cross-sectional dimension of each of said bores and said openings in said bores being greater than the cross-sectional dimension of said blade attached to the other said handtool, whereby translation to place said handtools into assembled storage is generally parallel to the extending length of said blades.

7. An assembly of two handtools as in claim 6, further including means for temporarily attaching said handtools to each other in their assembled storage position.

8. An assembly of two handtools as in claim 6, further including a pocket clip provided on at least one of said handles.

9. An assembly of two handtools as in claim 6 wherein said handles each have substantially the same cross section along the elongated dimension of said handles, said cross sections having a center axis parallel to the elongated dimension of said handles, at least one of said blades being attached to said handle offset from the center axis of said handle, whereby the center axes of both of said handles are co-axial in said assembled handtool unit and said assembled handtool unit has a uniform outer cross section.

10. An assembly of two handtools as in claim 9 wherein each of said handles has an elliptical cross section.

11. An assembly of two handtools as in claim 6 wherein said handles each have substantially the same cross section along the elongated dimension of said handles, said cross sections having a center axis parallel to the elongated dimension of said handles, each of said blades having at least one bend in the extending length of said blade, said bores and said openings in said bores being shaped to accept said bent blades, whereby the center axes of both of said handles are co-axial in said assembled handtool unit and said assembled handtool unit has a uniform outer cross section.

12. An assembly of two handtools as in claim 5 wherein said cavities are slots, said slots having openings along the elongated dimension of said handles, said slots and said openings in said slots each having a length and width greater than said extending length and width of said blade attached to the other said handle, whereby translation to place said handtools into assembled storage is generally perpendicular to the extending length of said blades.

13. An assembly of two handtools as in claim 12, further including means for temporarily attaching said handtools to each other in their assembled storage position.

14. An assembly of two handtools as in claim 12, further including a pocket clip provided on at least one of said handles.

15. An assembly of two handtools as in claim 12 wherein said handles each have substantially the same cross section along the length of said handles, said cross sections having a center axis parallel to the elongated dimension of said handles, at least one of said blades being attached to said handle offset from the center axis of said handle, whereby the center axes of both of said handles are co-axial in said assembled handtool unit and said assembled handtool unit has a uniform outer cross section.

16. An assembly of two handtools as in claim 12 wherein said handles each have substantially the same cross section along the elongated dimension of said handles, said cross sections having a center axis parallel to the length of said handles, each of said blades having at least one bend in the extending length of said blade, said slots and said openings in said slots being shaped to accept said bent blades, whereby the center axes of both of said handles are co-axial in said assembled handtool unit and said assembled tool unit has a uniform outer cross section.

* * * * *